US008336338B2

(12) United States Patent
Cimetta et al.

(10) Patent No.: US 8,336,338 B2
(45) Date of Patent: Dec. 25, 2012

(54) LIFTING RIBS OF THE DRUM OF A CLOTHES WASHING MACHINE

(75) Inventors: Silvano Cimetta, Treviso (IT); Flavio Noviello, Aviano (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 915 days.

(21) Appl. No.: 12/162,461

(22) PCT Filed: Dec. 22, 2006

(86) PCT No.: PCT/EP2006/012498

§ 371 (c)(1),
(2), (4) Date: Jul. 28, 2008

(87) PCT Pub. No.: WO2007/087887

PCT Pub. Date: Aug. 9, 2007

(65) Prior Publication Data

US 2009/0007600 A1 Jan. 8, 2009

(30) Foreign Application Priority Data

Feb. 2, 2006 (EP) ..... 06101185

(51) Int. Cl.
*D06F 37/06* (2006.01)
*D06F 23/02* (2006.01)

(52) U.S. Cl. ..... 68/24; 68/58; 68/142

(58) Field of Classification Search ..... 68/23.1, 68/24, 140, 142, 143
See application file for complete search history.

(56) References Cited

U.S. PATENT DOCUMENTS 1,111,126 A * 9/1914 Bercaw ..... 68/142
2,404,450 A * 7/1946 Meyer ..... 68/58
3,604,221 A * 9/1971 Pellerin ..... 68/12.19
3,715,898 A * 2/1973 Olliges, Sr. ..... 68/145
3,760,613 A * 9/1973 Henderson ..... 68/143
2002/0083743 A1* 7/2002 Uszkureit et al. ..... 68/58
2005/0097927 A1* 5/2005 Kim et al. ..... 68/24

FOREIGN PATENT DOCUMENTS

| | | |
|---|---|---|
| EP | 0 245 721 | 11/1987 |
| EP | 0 287 989 | 10/1988 |
| EP | 1 190 135 | 3/2004 |
| EP | 1 529 866 | 5/2005 |
| JP | 2005-137889 | 6/2005 |

OTHER PUBLICATIONS

International Search Report for PCT/EP2006/012498: Mar. 8, 2007.

* cited by examiner

*Primary Examiner* — Joseph L Perrin
(74) *Attorney, Agent, or Firm* — Pearne & Gordon LLP

(57) ABSTRACT

Front-loading clothes washing machine including a washing tub, a rotating drum contained in the tub and provided with an access opening and a rear wall, and a plurality of internally hollow lifting ribs arranged inside the drum and provided internally with a respective partition wall. The partition wall is in the shape of a substantially planar quadrangle, a side of which coincides with the common side of the inclined walls of the lifting rib, while the opposite side lies on the inner surface of the drum in a roughly intermediate position between the walls. The partition wall divides the inner volume of the respective lifting rib into two chambers that do not communicate with each other, and each one of the inclined walls is provided with at least a first respective aperture and a plurality of respective perforations adapted to let the respective one of the chambers communicate with the inner volume of the drum.

9 Claims, 9 Drawing Sheets

LIFTING RIBS OF THE DRUM OF A CLOTHES WASHING MACHINE

BACKGROUND OF THE INVENTION

1. Field of Invention

The present invention refers to an improved kind of clothes washing machine, preferably of the type intended for use in households, which is capable of operating in a particularly efficient and advantageous manner in controlling the flows of water contained in the machine.

2. Description of Related Art

While reference will be generally made to a single-duty clothes washing machine, i.e. a machine designed to only wash clothes, throughout the following description, it shall be understood that the considerations and explanations set forth and given hereinbelow equally apply to combined clothes washing and drying machines, i.e. the so-called washer-driers.

Known in the art are household-type front-loading clothes washing machines that are provided with a cylindrical washing tub, or outer drum, and a rotating drum accommodated inside said tub and holding the washload, i.e. the clothes to be washed. This rotating drum is provided with a plurality of perforations intended to enable the washing liquor to pass therethrough to flow into and out of the same drum.

These machines are also provided with re-circulating ways and means that are adapted to lift up the washing liquor from the bottom of the tub and pour it again and again into the drum, preferably into and through the washload itself, in view of enhancing the effectiveness of the washing action, while reducing both energy and water usage.

Machines of this kind are particularly efficient and their diffusion and popularity on the marketplace are indicative of them being largely accepted by the consumers, actually.

However, these machines, generally referred to as "re-circulating type" machines in the art, have an obvious major drawback in that they are significantly more expensive than traditional designs, since they require the construction of a re-circulating circuit, along with the pump and the various devices and arrangements associated thereto.

This problem becomes particularly acute, i.e. is particularly felt in the case of front-loading washing machines that are provided with a slightly upward-inclined drum, i.e. that have the loading opening, which is oriented towards the user to the purpose of making it more convenient to gain access thereinto and loading/unloading the clothes.

In fact, it usually occurs that the washload, which quite obviously tends to fall and arrange itself onto the bottom, will in this case concentrate onto the rear region of the drum, while leaving the front region thereof fully clear. Apart from the resulting difficulties that may be found in taking out the washload, this may affect the actual performance of the machine in terms of washing and drying effectiveness.

In view of at least partly doing away with such drawback, a solution that has been largely adopted in the art lies in sizing and shaping in a particular manner the lifting ribs that are usually applied on to the inner surface of the drum; these lifting ribs are in fact so contoured as to be higher (relative to the surface of the drum) in the rear portion thereof than they are in the front portion.

Such solution, therefore, enables the washload, which would spontaneously tend to gather and pile up in the rear region of the drum, to be caused to roll forwards, i.e. towards the front region of the drum as the latter rotates.

Such kinds of sloping lifting ribs are disclosed and described in a number of publications, including for instance the patents EP 1 190 135 81, EP 0 287 989 A2 and JP 2005-137889.

As far as the washing liquor is concerned, it should be noticed that, in view of reducing both water usage and, above all, energy usage, with particular reference to the amount of energy required to heat up the water, the latter is generally let into the washing tub to a particularly reduced amount. As a result, when the drum has an axis that is slightly inclined upwards, the water naturally tends to collect onto the bottom of the tub and, since also the tub has a same inclination as the axis of the drum, it accumulates in the rear region thereof, thereby proving practically unable to duly soak the part of the washload that lies in the higher portion of the drum, i.e. closer to the loading opening of the machine.

Even this occurrence turns out to further affect the performance capabilities of the machine by worsening the washing and drying effectiveness thereof, and such worsening effect is by no means relieved by the above-mentioned contrivance of having the drum provided with "sloping"-type lifting ribs.

In view of improving the distribution of the washing liquor by means of said lifting ribs, the afore-cited patent JP 2005-137889 discloses an internally hollow lifting rib, in which there is arranged at least one partitioning plate, wherein the interior of the same lifting rib is divided into two or more chambers. Thus, the washing water being pumped up by the lifting rib is evenly sprinkled all over the entire length of the lifting rib, as this is set forth concisely in the related Abstract. The diaphragms 31 and 32 are arranged in a longitudinal direction and divide the interior of the lifting rib 20 into different chambers 41, 42 and 43.

Although this solution is effective in improving the distribution of the washing liquor inside the lifting ribs, it however proves practically unable to improve the overall situation to any significant extent, since the problem does not lie so much in being able to improve liquor distribution inside the lifting rib, but rather in actually improving liquor distribution inside the drum itself. In this connection, the above-mentioned solution is far from reaching this aim to any satisfactory extent, since the liquor cannot be poured, i.e. transferred from the chamber 43 lying farthest away from the loading opening of the drum to the chamber 41 lying closer thereto, owing exactly to said diaphragms 31 and 32 being provided therebetween.

In addition, the fact that the sprinkling perforations 23 are provided along the outer edge of the lifting rib, and directly oriented towards the centre of the drum, gives rise to the undesired effect that, as soon as the lifting rib moves up to a just slightly higher position than the lowest one it has just moved away from, the liquor contained therein tends to leak out through said perforations so that, by the time the same lifting rib eventually reaches up to the highest position thereof, it has practically run empty.

This of course impairs the washing effect that can be achieved, since it reduces the amount of liquor that is actually sprinkled onto and through the washload and, above all, the amount of liquor that is distributed also over the outermost zones of the washload.

BRIEF SUMMARY OF THE INVENTION

It would therefore be desirable, and it is actually a main object of the present invention, to provide a clothes washing machine of the non-recirculating type, which is however provided with devices and operating modes that enable the washing liquor inside the tub to be adequately controlled so as to ensure operating and washing effects to be obtained that are fully comparable with those typical of recirculating-type machines.

The inventive washing machine shall be substantially similar to conventional-type washing machines, from which it shall solely differ due to just minor variations in their construction and operation characteristics that imply just significantly lower additional manufacturing costs, do not affect the overall operating reliability of the machine in any manner, and do not require the user to perform any different or particular handling when using the machine.

According to the present invention, these aims, along with further ones that will become apparent from the following description, are reached in a clothes washing and drying machine incorporating the characteristics as recited in the appended claims.

BRIEF DESCRIPTION OF THE DRAWINGS

Anyway, features and advantages of the present invention will be more readily understood from the description that is given below by way of non-limiting example with reference to the accompanying drawings, in which.

DETAILED DESCRIPTION OF THE INVENTION

Figure 1:
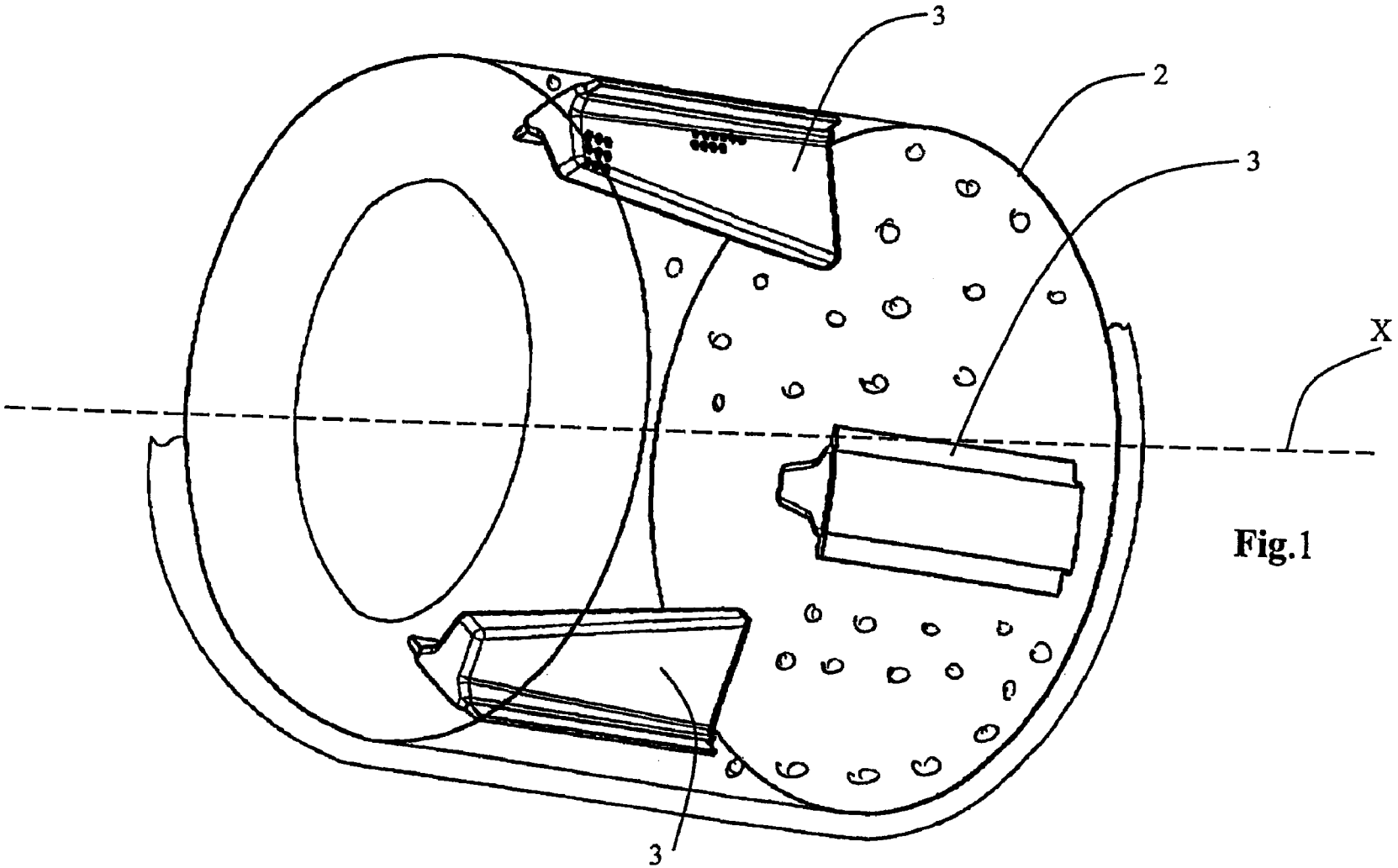
FIG. 1 is a perspective view of the tub and rotating drum assembly in a clothes washing machine according to the prior art.

With reference to FIG. 1, in a clothes washing machine according to the prior art there are provided a washing tub 1 containing the washing liquor, a rotating drum 2 containing the clothes to be washed, and a plurality of lifting ribs 3 distributed in an orderly arrangement along the inner surface of said drum.

Figure 2:
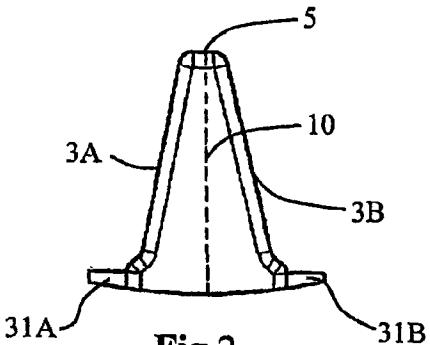
FIGS. 2, 3 and 4 are respective plan and orthogonal views of a lifting rib according to the present invention.
Figure 3:
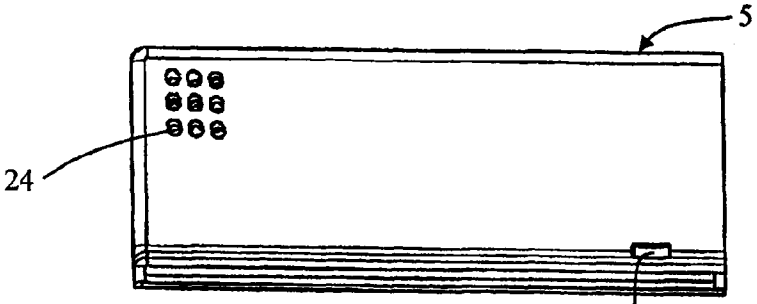
Figure 4:
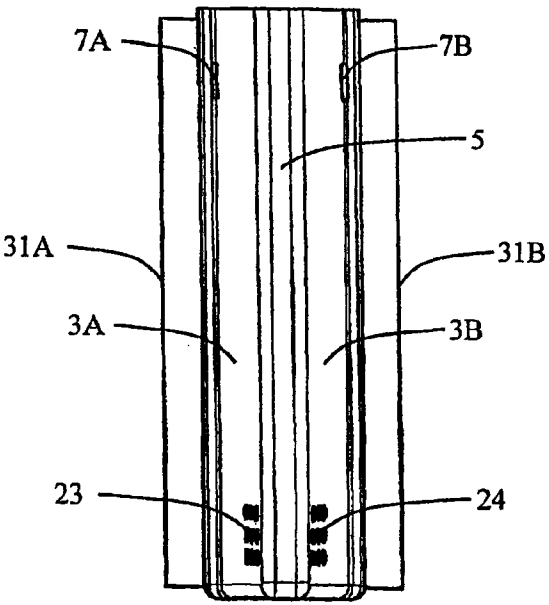
Figure 5:
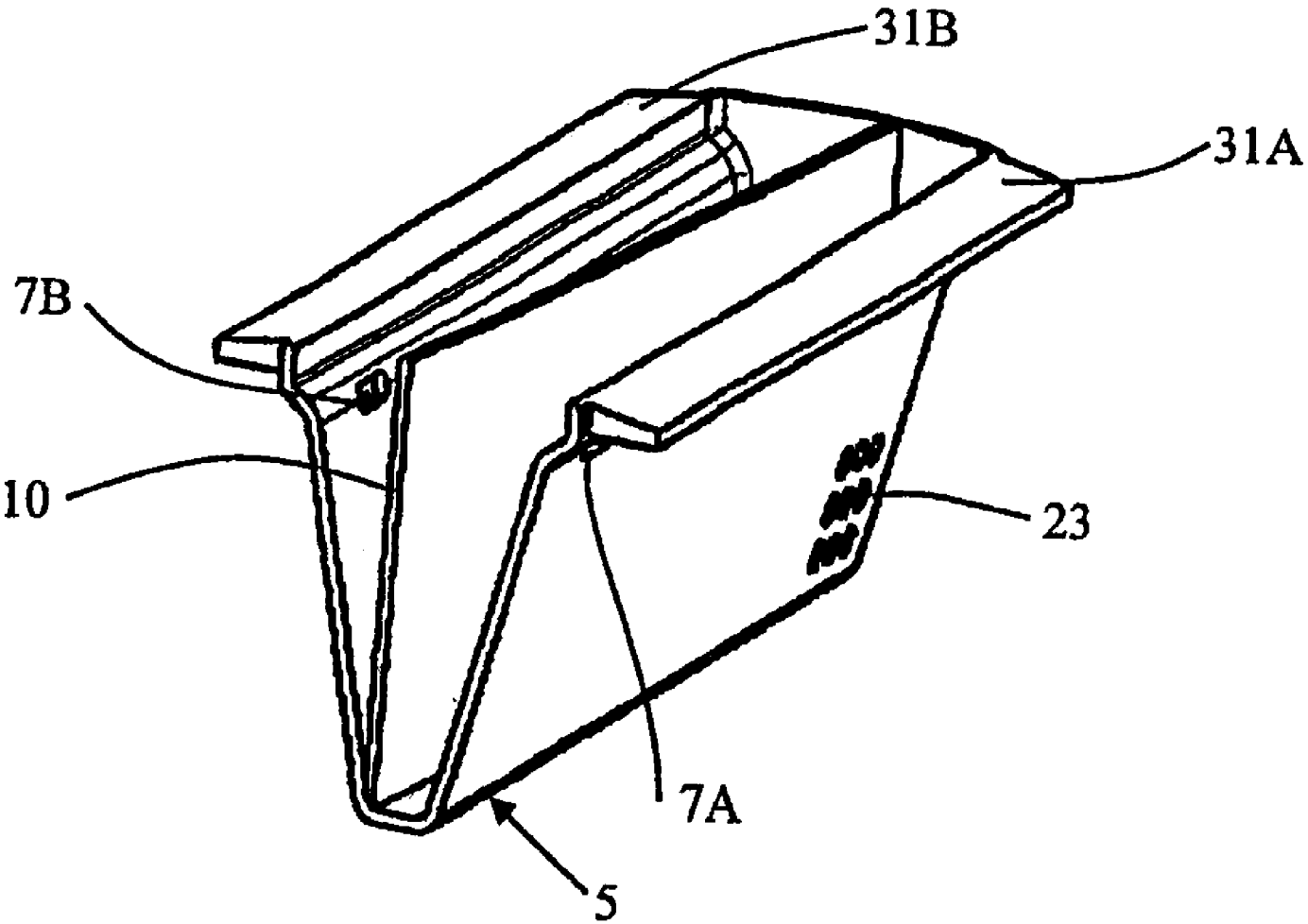
FIG. 5 is a perspective, partially see-through view of a lifting rib in the drum of a clothes washing machine according to the present invention.

With reference to FIGS. 2 to 4, which are three orthogonal views of a lifting rib according to the present invention, and to FIG. 5, which is an outer perspective view of the same lifting rib, this lifting rib 3 is provided with two walls 3A and 3B that are inclined relative to each other and are applied with their base sides 31A and 31B, respectively, onto the inner surface of the drum 2.

These two walls join each other along the common side 5 so as to generate a structure as illustrated in FIG. 2, largely known as such in the art.

Inside said lifting rib 3 there is situated a partition wall 10 in the form of a planar, rectangular member, which is arranged with the major side thereof joining with said common side 5 of the two walls of the lifting rib, whereas the opposite side 11 thereof joins with the base of the same lifting rip, at a point located approximately halfway across said base, which coincides with the quadrangle defined by said two base sides 31A and 31B.

In other words, said partition wall comes to lie on the plane that passes also across the axis of rotation X of the drum, and in which there extends also said common side 5.

Basically, therefore, said partition wall bisects said lifting rib lengthwise, thereby creating two symmetrical portions thereof.

Jointly with each one of said walls 3A and 3B, with the portion of drum inner surface corresponding thereto and, of course, with the drum base surfaces lying orthogonally to and delimited by said walls and said partition, said partition wall 10 forms two respective closed chambers 20, 21.

In said inclined walls 3A and 3B there are provided apertures 7A and 7B, respectively, which are situated in the rear portion of said walls (wherein the meaning of the terms "rear" and "front", as used here, is assumed to be fully clear to those skilled in the art), in the region close to the respective base side 31A and 31B thereof, i.e. substantially near the surface of the drum.

The purpose of these apertures in each lifting rib is to enable the washing liquor to flow into said chambers from the interior of the drum when the drum rotates into the position in which the respective lifting rib comes to lie in its lowest position, i.e. it is certainly submerged in the washing liquor lying on the bottom of the tub.

In the same inclined walls 3A and 3B there is also provided a respective plurality of perforations 23, 24 arranged in the front region thereof, and diagonally relative to the respective apertures 7A, 7B, so that the wall 3A is provided with both the aperture 7A and the perforations 23, while the wall 3B is similarly provided with both the aperture 7B and the perforations 24.

The way in which such lifting rib works in the various rotational positions of the drum is as follows: in this connection, let FIGS. 6 to 9 be first of all considered, which illustrate the lifting rib 3 in respective moments and positions during the rotation of the drum.

Figure 6:
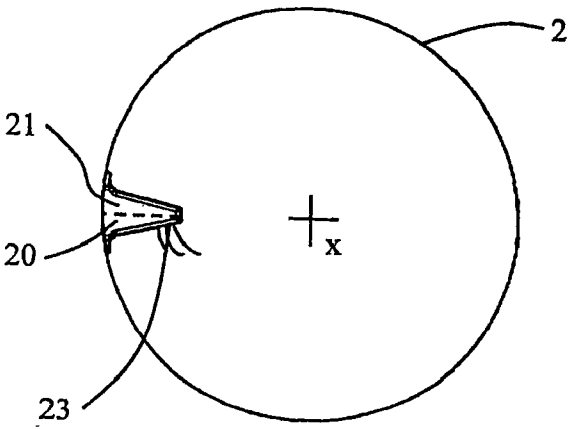

More specifically, FIG. 6 shows that, when the lifting rib 3 has just slightly moved up from the lowest point I, and lies approximately in a position at 90° relative thereto, the liquor contained in the previously filled lower chamber 20 starts to be sprinkled out through the perforations 23 of the respective wall 3A, whereas the liquor contained in the adjacent chamber 21 cannot of course escape therefrom, since the respective wall 3B and, as a result, the related perforations 24 are facing upwards and, therefore, lie at a higher level than the liquor contained in the same chamber 3B.

Figure 7:
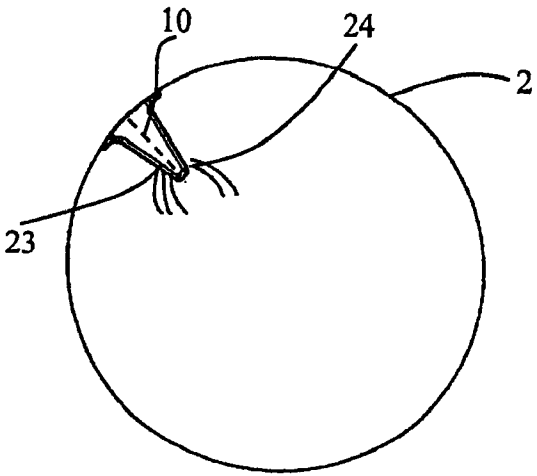

FIG. 7 shows that, when the lifting rib 3 moves up to an intermediate position between the previous one and the highest reachable position, the liquor contained in the lower chamber 20 continues of course to spill out through the perforations 23, while the liquor contained in the adjacent chamber 21 can at this point either start to be poured out and sprinkled into the drum or cannot yet spill out therefrom, depending on the particular geometry of the lifting rib itself and the actual arrangement of the related perforations 24.

Figure 8:
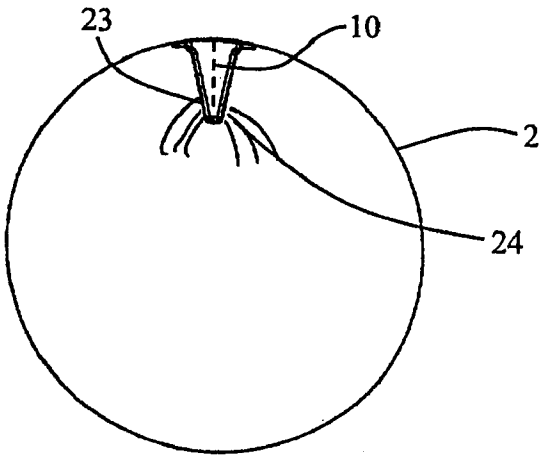
FIGS. 6 to 9 are respective symbolical views, from a point situated on the axis of rotation X of the drum in front of the latter, of a lifting rib according to the present invention, in different angular position of the drum, along with the related displacements of the washing liquor thereinside.

FIG. 8 shows that, when the lifting rib 3 reaches up to the highest position thereof, the liquor contained in both chambers 20, 21 is able to spill out through the respective perforations; however, while the first chamber 20 is almost empty at this point, owing to the liquor contained therein having already been sprinkled out in the meanwhile, the second chamber 21 is still substantially full and lies with the respective perforations 24 almost facing downwards, so that the flow of liquor being sprinkled out through such perforations 24 is most copious.

This particular way of working, therefore, enables the main aim of the present invention to be fully reached, since an almost continuous flow of liquor is practically brought about, wherein such flow comes from above, and above all from the interior of the same drum, and is directed downwards, exactly towards the centre of the drum where the washload that must be sprinkled and soaked with such liquor lies.

Figure 9:
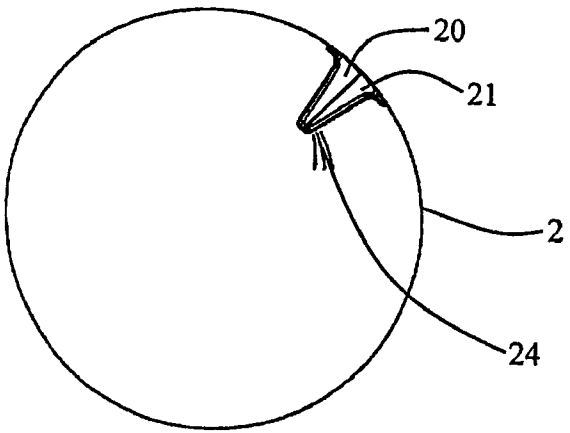

FIG. 9 shows that, when the lifting rib 3 moves away from the above-cited position, i.e. starts moving downwards, the liquor contained in the chamber 21 keeps spilling out from the respective perforations 24, since the latter are now oriented exactly downwards, so as to enable the chamber 24 to run completely empty.

This has of course also the effect of boosting the effectiveness of the sprinkling action from above, since it is enabled to last for a longer period of time.

In view of better understanding the actual difference existing between the present invention and the teaching in the afore-cited publication JP 2005-137889, it should be noticed that in the lifting rib described in said publication there is provided a perforated wall 21, provided with the perforations 23, in which this wall is however substantially and constantly oriented towards the centre of the drum, in any position whatever of the lifting rib which it is associated to, so that the liquor contained in the related two chambers starts to immediately spill out as soon as the lifting rib moves up just a short way from the lowest position thereof. This results in a couple of negative consequences, both of which acting in the sense of first reducing and then hindering liquor outlet towards the centre of the drum in each rotational position of the same drum and, as a result, the lifting ribs.

The first negative consequence arises from the fact that, owing to the wall 21 being constantly oriented towards the centre, the chambers tend to run almost immediately empty, since there is no possibility given for a part of the liquor to be retained in the lifting rib during the first phase, as this on the contrary occurs in the case of the inventive lifting rib, in which the second chamber 21 practically starts to let out, i.e. sprinkle liquor only when the related lifting rib reaches up to the highest position thereof. It ensues that, with the prior-art solution, no possibility is given for the liquor to be caused to spill out, i.e. to be sprinkled towards the centre of the drum from an elevated position of the lifting rib.

The second above-mentioned negative consequence derives from the fact that, owing to no partition wall being provided as in the case of the inventive lifting rib, there is practically no possibility given for the liquor to be retained inside the lifting rib for half a turn of the drum for giving it off at the most appropriate moment, i.e. when the lifting rib is reaching up to the highest position thereof.

Figure 10:
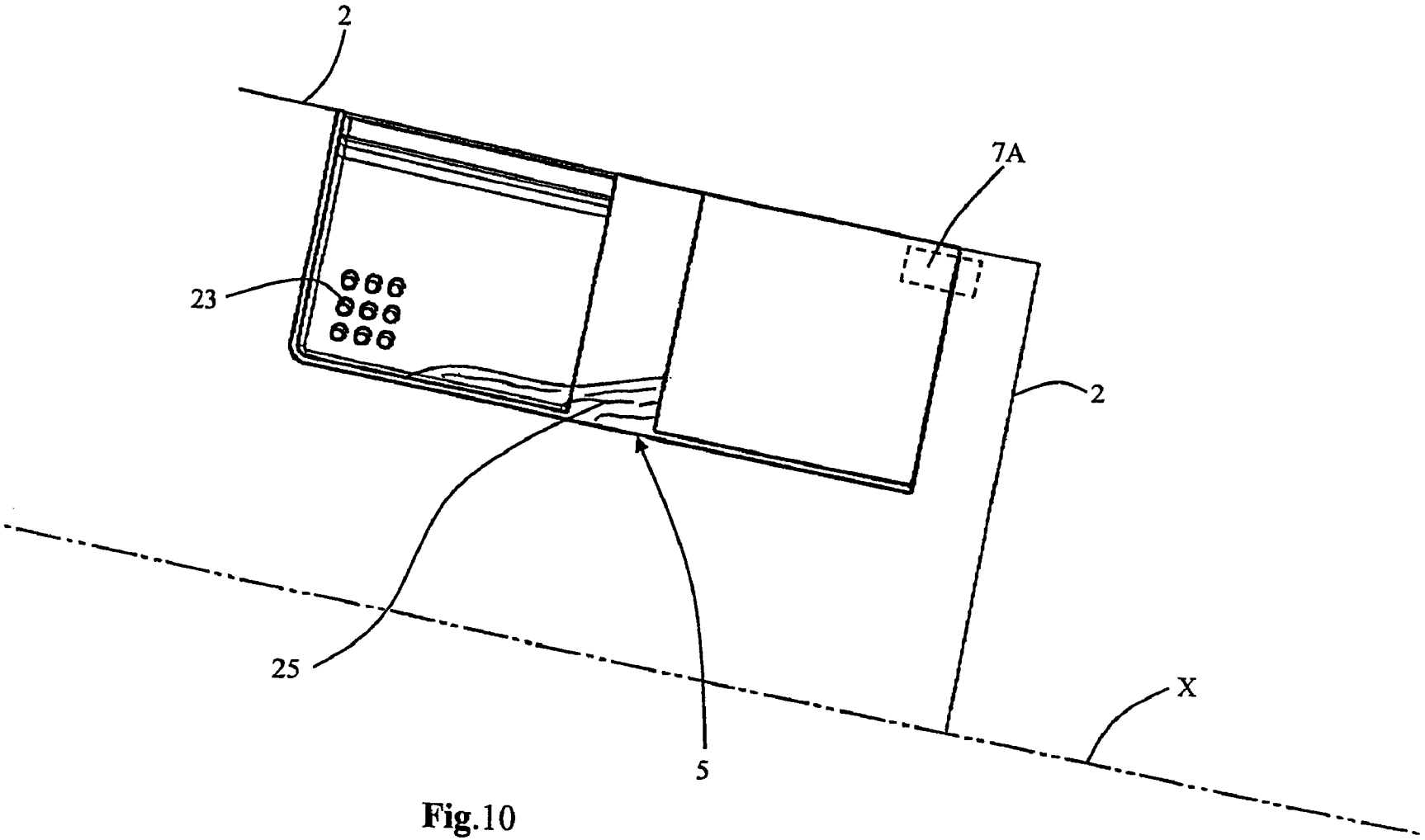
FIG. 10 is a side, see-through view of a lifting rib according to the present invention, in the case that the axis of rotation X of the drum is slightly inclined upwards.

As it has been generally described above, the inventive solution, although quite advantageous, has anyway a drawback in that, when the front-loading clothes washing machine that uses the lifting ribs according to the present invention is provided with a slightly upward inclined drum, i.e. a drum having the access opening thereof oriented towards the user, the two chambers 20 and 21, when in the highest position thereof, have a kind of pocket 25 forming in the lower region thereof comprised in the volume of said two chambers (see FIG. 10, in which such pocket is drawn so as to apply to both chambers), which reduces the actual effectiveness of the present invention to quite a considerable extent. In fact, in a front-loading clothes washing machine having a drum that is slightly inclined upwards, as in the case illustrated in FIG. 10, the liquor will most obviously tend to fill such pocket 25; as a result, the level of such liquor relative to the perforations 23 and 24 lowers, thereby reducing the amount of liquor that can be spilled, i.e. let out through said perforations.

Figure 11:
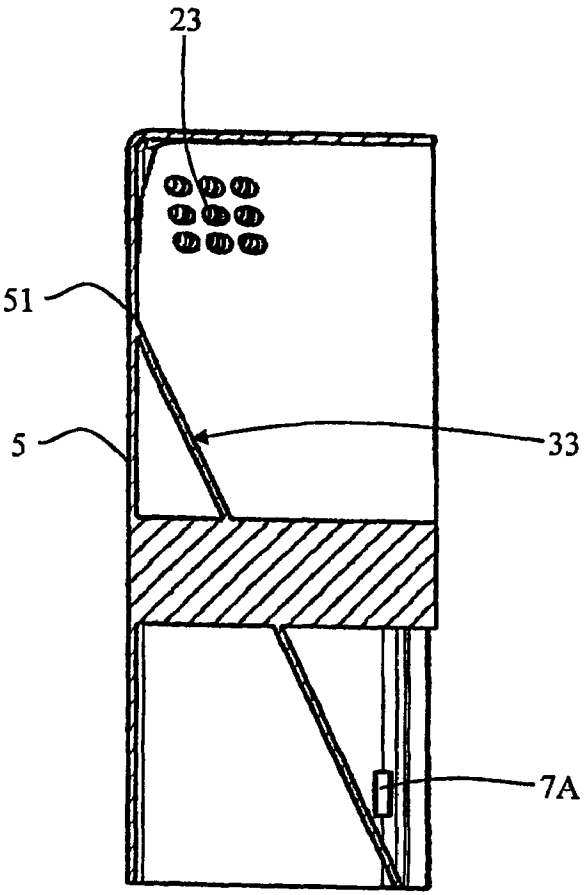
FIGS. 11 and 12 are respective orthogonal cross-sectional views of an improved embodiment of a lifting rib according to the present invention.
Figure 12:
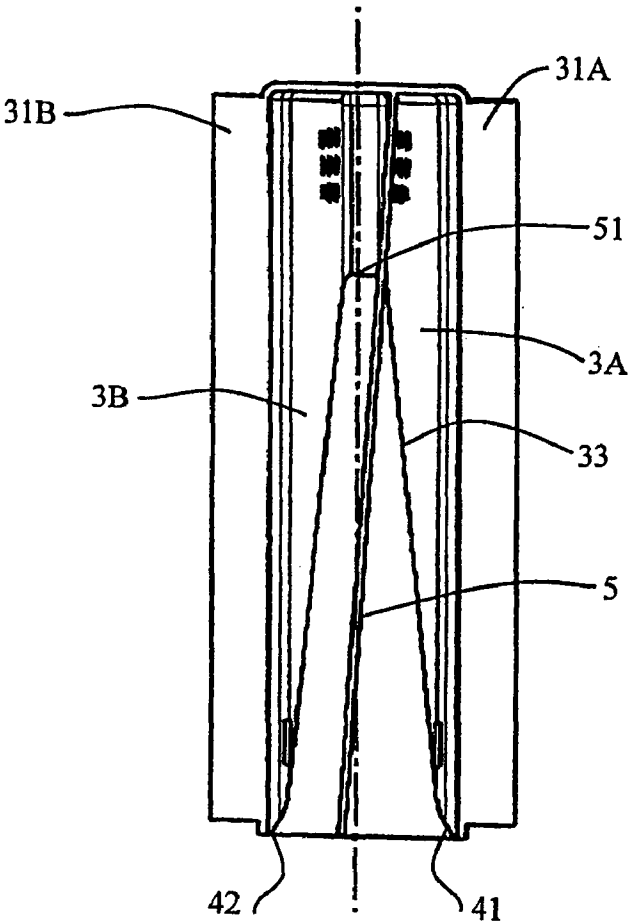
Figure 13:
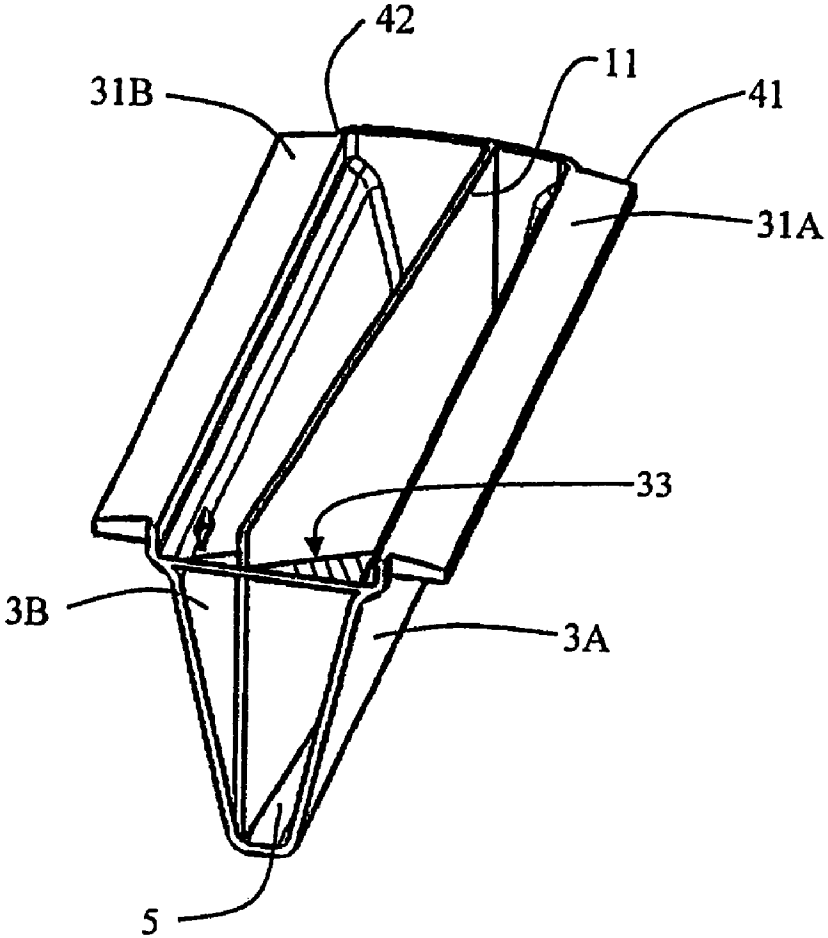
FIG. 13 is a perspective, see-through view of the lifting rib shown in FIGS. 11 and 12.

In view of doing away with such drawback, following improvement may therefore be embodied: with reference to FIGS. 11 to 13, the internal volume of the lifting rib 3 is not totally hollow, apart from the presence of the partition wall 10, in that there is provided a second planar partition 33 that is so arranged as to pass through the two intersection points 41, 42 of each one of said base sides 31A and 31B with the rear wall of the drum.

Inside the lifting rib 3, said second planar partition 33 is fully comprised within and delimited by said two inclined walls 3A and 3B, and intersects said common side 5 at a point 51 that is situated in a roughly intermediate position thereof.

In this way, said two chambers 21 and 22 come practically to take a trapezoidal shape, as indicated by the dashed line in FIG. 11, so that they are deprived of said pocket 25 that becomes inaccessible to the liquor and, as a result, remains empty.

Thus, the liquor distributes inside the hatched volume in FIG. 11, in such an arrangement and position inside the two chambers as to enable it to fully spill out through the same perforations 23, 24.

Quite obviously, the apertures 7A and 7B themselves are not modified, since also with the second partition 33 being so provided, the position of said apertures enables the liquor to be collected from the bottom of the tub in the same, unaltered manner.

The condition may however come about, in which, when the lifting rib is in its highest position, the inclination of said second partition 33 relative to the horizon r is directed downwards starting from said point 51 towards the bottom of the drum; as a result, it occurs that the liquor, instead of distributing towards the sprinkling, i.e. spill-out perforations 23, 24, tends to collect towards the rear region of the related chambers, thereby reducing the amount of liquor that can ultimately be poured out and, therefore, affecting the actual effectiveness of the present invention.

Figure 14:
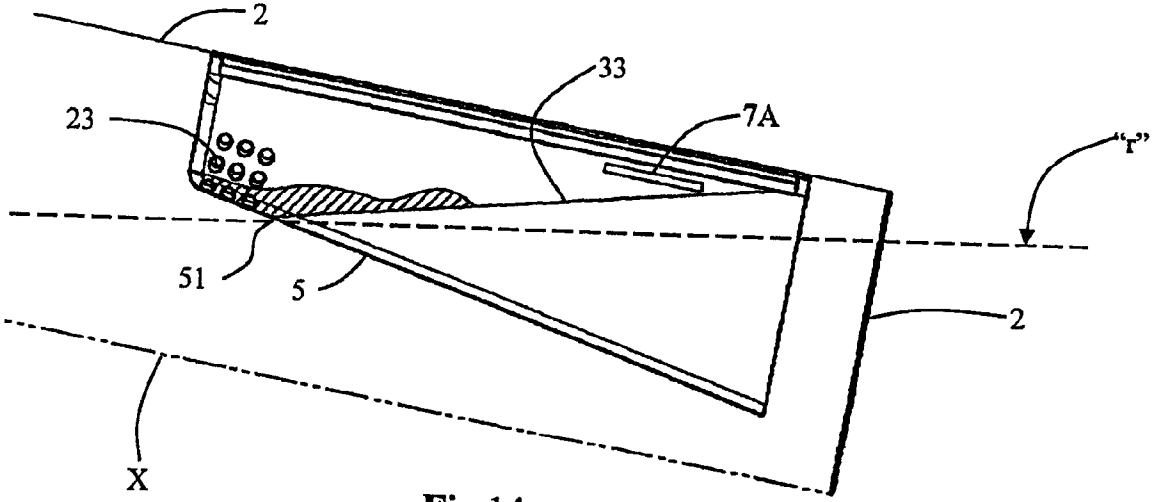
FIG. 14 is a view of an improved embodiment of the lifting rib shown in FIG. 11, in the highest position reached by it inside the drum.

For such drawback to be done away with, all it takes is to simply orientate the inclination of said partition 33 relative to the axis of the drum so that, when the lifting rib is rotated up to its highest position, said partition comes to lie in a position that is higher than, or at least on the same level as, the position of the horizontal plane r passing through said intermediate point, as this is clearly illustrated in FIG. 14.

Figure 15:
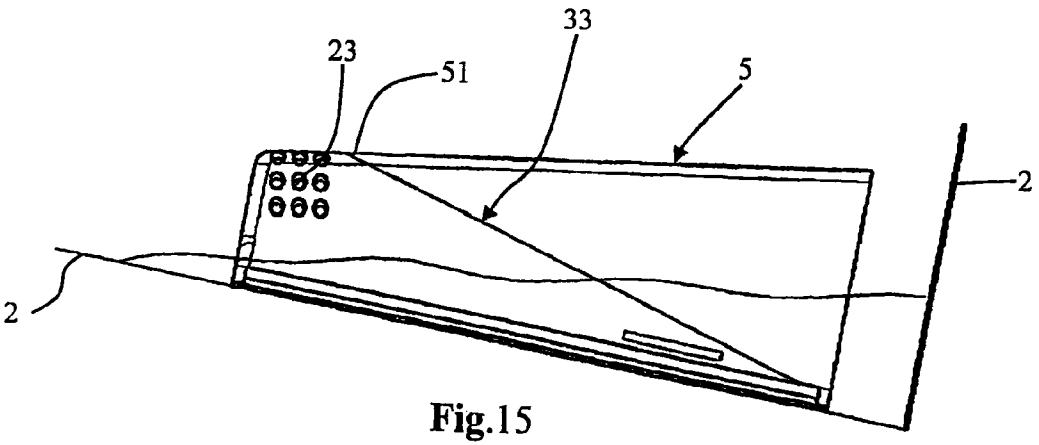
FIGS. 15 and 16 are side and front views, respectively, of a further improved embodiment of a lifting rib according to the present invention.
Figure 16:
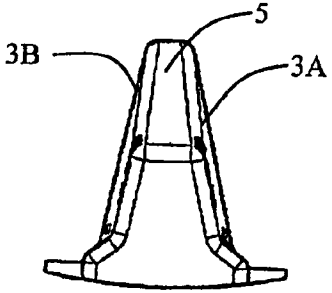

Moreover, a further improvement can be obtained if said common side 5 is not parallel to the axis of the drum, but is rather sloping down in the back-to-forth direction, as this is shown symbolically in FIGS. 15 and 16, in which H is greater than h.

In fact, in the case that the drum has its axis inclined upwards as explained hereinbefore by way of example, configuring the contour of the lifting ribs in this way enables the washload to be suitably pushed towards the access opening of the drum as it is tumbled therewithin, while keeping all other above-noted advantages and characteristics unaltered.

This effect practically enables the natural tendency of the washload to gather onto the bottom of the drum—thereby making it rather awkward for the user to take out the same washload from the drum at the end of the washing process—to be effectively opposed.

Figure 17:
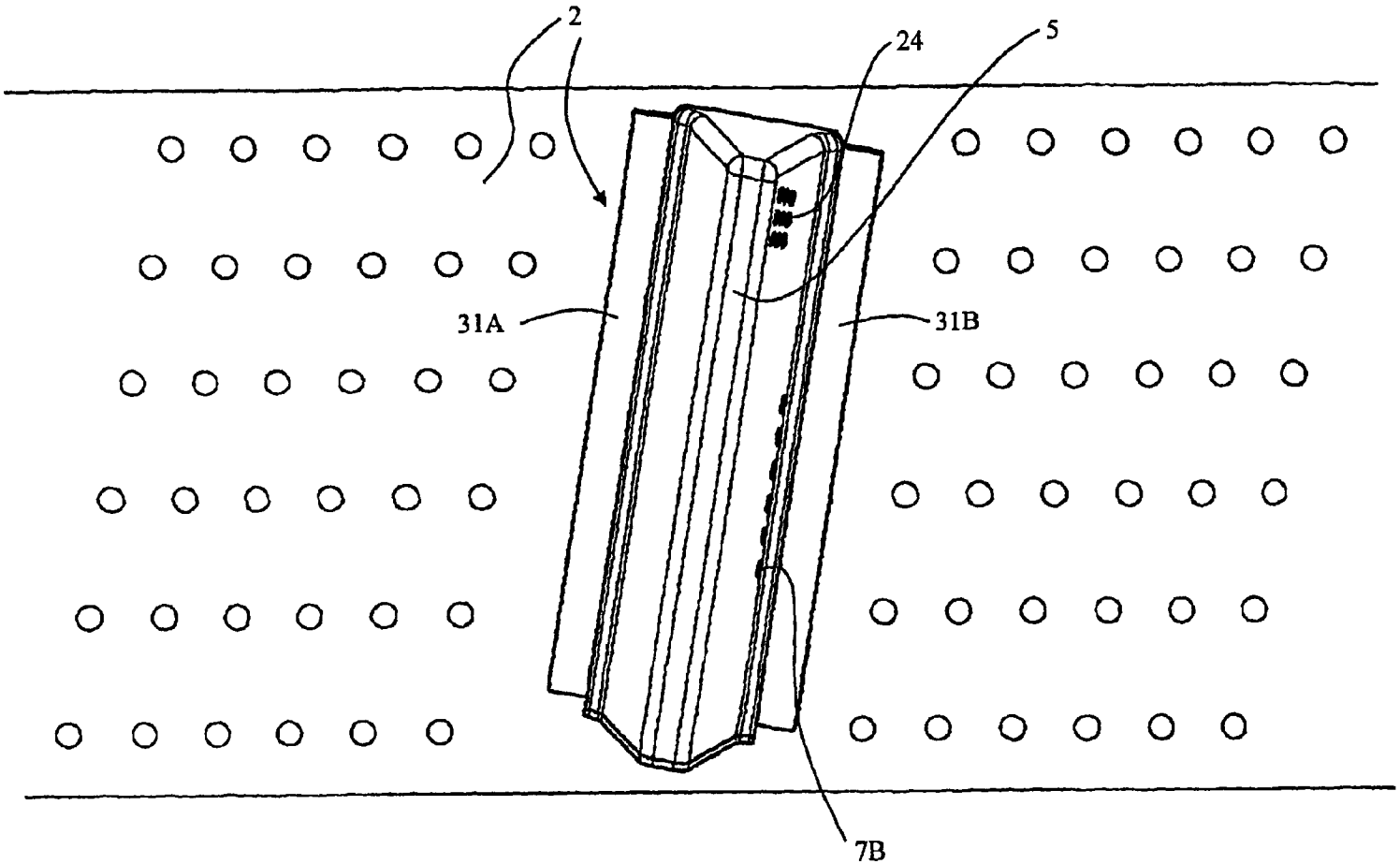
FIG. 17 is a plan top view of the layout on the plane of the drawing of a further improved embodiment and assembly of a lifting rib according to the present invention.

With reference to FIG. 17, a further improvement can be finally obtained if the inventive lifting ribs are not arranged to extend across, i.e. transversally to the cylindrical side wall of the drum, but rather diagonally, i.e. slantwise relative thereto.

In order to more clearly explain and define this particular feature, FIG. 17 illustrates the way in which such lifting ribs may in fact be oriented relative to and arranged on the surface of the cylindrical side wall of the drum.

A twofold advantage can be derived from a solution of the above-mentioned kind, i.e.

an improvement in the afore-described effect of inducing the washload to displace longitudinally towards the access opening of the drum, in the case that the latter is oriented upwards, i.e. towards the user, when the drum rotates in a preferential direction during the washing phase;

when the drum is on the contrary driven to rotate at a high spin-extraction speed, this must occur in a direction of rotation opposite to the preferential one, wherein the washload is in this case induced to displace in an opposite direction, i.e. towards the bottom of the drum; it shall however be noticed that this is an advantageous and favourable condition, actually, since the torque acting on the bearings that support the drum is reduced to a considerable extent, owing to the much shorter average arm of the same torque resulting from the washload being so pushed towards the bottom of the drum and, therefore, closer to the bearings that support the same drum.

What is claimed is:

1. Front-loading clothes washing machine, comprising:

a washing tub (1) adapted to contain washing liquor and a washload, a rotating drum (2) contained in said tub and provided with an access opening and a rear wall, the axis of rotation of the drum is inclined upwards toward the access opening, a plurality of internally hollow lifting ribs (3) applied on to the inner surface of said drum and provided with at least a respective partition wall arranged thereinside, said lifting ribs being comprised of two walls (3A, 3B) that are inclined relative to each other so as to join with each other along a common side (5) extending inside said drum, and being further attached to the inner surface of the drum with respective base sides (31A, 31B), said internally hollow lifting ribs (3) having apertures (7A, 7B, 23, 24) to allow the washing liquor to enter the ribs, wherein said respective partition wall is in the shape of a substantially planar quadrangle (10), a side of which coincides with said common side (5) of said inclined walls, while an opposite side (11) lies on the inner surface of said drum in a roughly intermediate position between said walls (3A, 3B), wherein the lifting ribs are provided internally with a second substantially planar partition (33) that extends through the respective intersections (41, 42) of the base sides with the rear wall of the drum, and with a point (51) that lies in an intermediate position along the common side (5), and wherein inside each internally hollow lifting rib, the partition walls (10, 33) defining therebetween a volume which is inaccessible to said washing liquor.

2. Clothes washing machine according to claim 1, wherein said partition wall (10) divides the inner volume of said respective lifting rib into two chambers (20, 21) that do not communicate with each other.

3. Clothes washing machine according to claim 1, wherein each one of said inclined walls (3A, 3B) is provided with at least a first respective aperture (7A, 7B) and a plurality of respective perforations (23, 24) adapted to let the respective one of said chambers communicate with the inner volume of the drum.

4. Clothes washing machine according to claim 3, wherein said respective apertures (7A, 7B) are situated in the portion of the respective wall that lies close to the respective base side (31A, 31B), and said perforations (23, 24) are situated in the portion of the respective wall that lies close to said common side (5).

5. Clothes washing machine according to claim 4, wherein said respective apertures (7A, 7B) are situated in the portion of the respective wall that lies close to the rear wall of said drum, and said perforations (23, 24) are situated in the portion of the respective wall that lies farthest away from that same rear wall.

6. Clothes washing machine according to claim 1, wherein said second partition (33) is arranged at an angle relative to said base sides of said lifting rib with such an inclination that, when the respective lifting rib lies in the highest rotational position of the drum, said partition is in a position that is higher than, or at least on the same level as, the position of the horizontal plane (r) passing through said intermediate point (51).

7. Clothes washing machine according to any of the preceding claims, wherein the common side (5) of a respective lifting rib has a downward-sloping contour, wherein the distance between it and the cylindrical surface of the drum is greater when it gets close to the rear wall of the drum and is increasingly smaller as it moves near the access opening of the same drum.

8. Clothes washing machine according to claim 1, wherein said lifting ribs are substantially inclined also relative to the generant of the cylinder of the drum that passes through a respective one of said base sides (31A, 31B).

9. Clothes washing machine according to claim 8, wherein the rotating drum is provided with a preferential direction of rotation during the washing phase, and a preferential direction of rotation during the spin-extraction phase, wherein said two preferential directions of rotation are opposite to each other, and in that during the washing phase, when the rotation of the drum is the same as said preferential direction of rotation during the washing phase, the inclination of said lifting ribs relative to said generant of the cylinder of the drum is such as to favour the displacement of the washload towards said access opening of the drum.

* * * * *